US005694001A

United States Patent [19]

Wielstra

[11] Patent Number: 5,694,001

[45] Date of Patent: Dec. 2, 1997

[54] PICTURE DISPLAY DEVICE PROVIDED WITH AN AUTOMATIC SELECTIVELY TRANSMISSIVE COATING

[75] Inventor: Ytsen Wielstra, Eindhoven, Netherlands

[73] Assignee: U.S. Philips Corporation, New York, N.Y.

[21] Appl. No.: 548,936

[22] Filed: Oct. 26, 1995

[30] Foreign Application Priority Data

Nov. 21, 1994 [EP] European Pat. Off. ..... 94203374

[51] Int. Cl.[6] ..... H01J 29/89

[52] U.S. Cl. ..... 313/478; 313/479; 313/110

[58] Field of Search ..... 313/112, 110, 313/478, 479

[56] References Cited

U.S. PATENT DOCUMENTS 4,685,783 8/1987 Heller et al. ..... 351/163

5,060,075 10/1991 Skinner ..... 358/250

5,534,748 7/1996 Oomen ..... 313/478

*Primary Examiner*—Nimeshkumar Patel

[57] ABSTRACT

A picture display device is provided with a display screen for transmitting light in a spectral range, and a selectively transmissive coating. The local transmission of the coating in the spectral range is dependent on the radiation which is locally incident on the coating, while the transmission of the coating automatically decreases as the intensity of the incident radiation increases. The transmission of the coating is preferably dependent on the radiation which is incident on the coating at a wavelength outside the spectral range. Such a device has the advantage that the contrast is enhanced in an optimum way, even if the ambient light is not homogeneously distributed across the display screen.

21 Claims, 3 Drawing Sheets

PICTURE DISPLAY DEVICE PROVIDED WITH AN AUTOMATIC SELECTIVELY TRANSMISSIVE COATING

BACKGROUND OF THE INVENTION

The invention relates to a picture display device provided with a display screen, means for transmitting light in a special emission range, and a selectively transmissive coating.

Selectively transmissive coatings for reducing the light transmission are used in picture display devices such as, for example cathode ray robes (CRT) and liquid crystal display devices (LCD and LC-TV) so as to enhance the contrast of the reproduced picture. Such coatings reduce the transmission of both the incident ambient light and light from an internal light source, for example the CRT phosphors. The incident ambient light passes the light-absorbing coating and the display screen. If the transmission of the light-absorbing coating is T, the intensity of the reflected ambient light is reduced by a factor of $T^2$. On the other hand, the light from the internal light sources passes light-absorbing coating only once so that the internal of this light is reduced by a factor of T only. The combination of these effects causes an increase of the contrast by a factor of T.

A picture display device of the type described in opening paragraph is known from U.S. Pat. No. 5,060,075, in which the contrast of a luminescent picture is enhanced by providing a panel on the face plate of a CRT picture display device, which panel reduces the reflection of the ambient light when the brightness of the ambient light increases. A light sensor, which is arranged proximate to the face plate, detects changes in the ambient light and, when the picture display device is switched on, a control circuit which is electrically connected to the light sensor and the panel produces such a control signal that the extent to which the panel passes light is inversely proportional to the increase of the intensity of the ambient light.

Such a device has the drawback that the contrast is not enhanced to an optimum extent when the ambient light is not homogeneously distributed across the screen.

SUMMARY OF THE INVENTION

It is an object of the invention to provide a picture display device of the type described in the opening paragraph, yielding a better enhancement of the contrast. To this end the picture display device according to the invention is characterized in that the local transmission of the coating in the emission range is dependent on the radiation which is locally incident on the coating, while the transmission of the coating decreases as the intensity of the incident radiation increases. The known state-of-the-art light sensor is not capable of compensating for intensity differences which occur between the ambient light incident on the light sensor and the ambient light incident on the display screen. Moreover, the light sensor is not capable of compensating for intensity differences which occur between locations on the display screen where ambient light of different intensities is incident.

The picture display device is preferably characterized in that the transmission of the coating in the spectral emission range referred to in the opening paragraph is dependent on the radiation which is incident on the coating at a wavelength outside said spectral range. As a result, the transmission of the coating is not influenced by light transmitted by the picture display device itself.

A further embodiment of the picture display device is characterized in that the transmission of the coating in the emission range changes due to radiation which is incident on the coating at a shorter wavelength than said spectral range. Since the display screen mainly transmits visible light, radiation having a larger wavelength than said spectral range will mainly originate from the infrared pan of the electromagnetic spectrum. By excluding these wavelengths, the transmission of the coating is not influenced by a thermal source proximate to the display screen.

An embodiment of the picture display device, in which the spectral emission range comprises a plurality of sub-ranges, at least two of which are separated by an intermediate further spectral range, is characterized in that the transmission of the coating in the emission range is dependent on the radiation incident on the coating at a wavelength in the intermediate range. In a picture display device, the means for emitting light usually comprise (three types of) known electroluminescent phosphors. In the wavelength range which is visible to the human eye, there is a number of sub-(wavelength) ranges in which the known phosphors do not emit or hardly emit (<10%) light. If the transmission of the light-transmissive coating is dependent on radiation in such a sub-range, the transmission of the coating will change when visible light comprising radiation in said sub-range is (locally) incident on the coating without the transmission of the coating being influenced by the emission of the phosphors themselves.

A further embodiment of the picture display device is characterized in that the color point coordinates (x,y) of the coating in the C.I.E. chromaticity diagram are between 0.3 and 0.37 and preferably between 0.31 and 0.35. A coating having such a color point has little influence on the color(s) of the picture displayed by the display device.

These and other aspects of the invention will be apparent from and elucidated with reference to the embodiments described hereinafter.

BRIEF DESCRIPTION OF THE DRAWINGS

In the drawings.

The Figures are diagrammatic and not to scale. For the sake of clarity, some dimensions are exaggerated. Similar components in the figures have identical reference numerals as much as possible.

DETAILED DESCRIPTION OF THE PREFERRED EMBODIMENTS

Figure 1A:
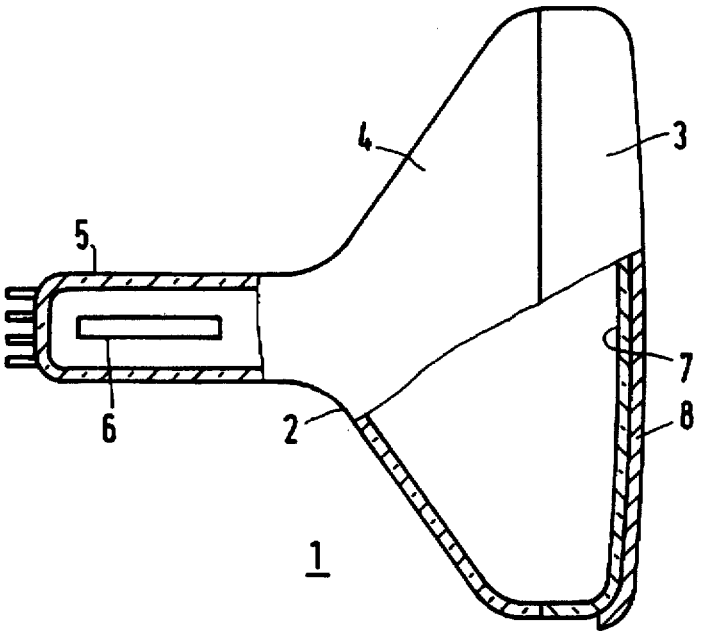
FIG. 1A is an elevational view, partly broken away, of a picture display device comprising a cathode ray tube.

FIG. 1A is a diagrammatic elevational view, partly broken way, of a cathode ray tube 1 having a glass envelope 2 comprising a display screen 3, a cone 4 and a neck 5. The neck accommodates an electron gun 6 for generating one or more electron beams. This (these) electron beam(s) is (are) focused on a phosphor layer 7 on the inner side of the display screen 3. The electron beam(s) is (are) deflected across the display screen 3 in two mutually perpendicular directions by means of a system of deflection coils (not shown in FIG. 1A). The outer side of the display screen 3 is provided with a coating 8.

Figure 1B:
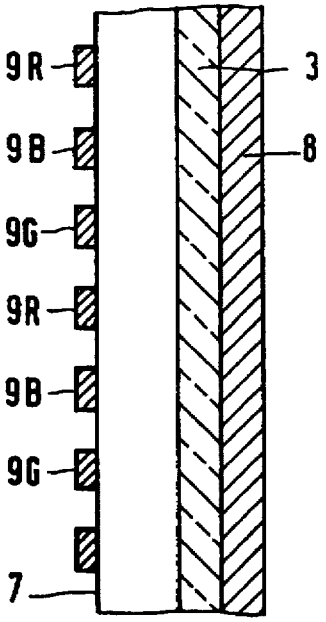
FIG. 1B is a cross-section of a detail of FIG. 1A.

FIG. 1B is a cross-section of a detail of FIG. 1A, in which phosphor layer 7 comprises a regular pattern of electroluminescent pixels 9R, 9G, 9B. Each pixel 9R, 9G, 9B comprises a suitable phosphor of the correct color: red 9R, green 9G or blue 9B. The outer side of the display screen 3 is preferably provided with a coating 8. Coating 8 comprises at least a material whose transmission changes due to electromagnetic radiation, for example light which is incident on the coating. Such a coating is also referred to as photochromic coating. The properties of photochromic materials are described in "Studies in Organic Chemistry 40: Photochromism (Molecules and Systems)" (Ed. H. Durr and H. Bouas-Laurent; Elsevier (1990); ISBN 0-444-87432-1).

Figure 2:
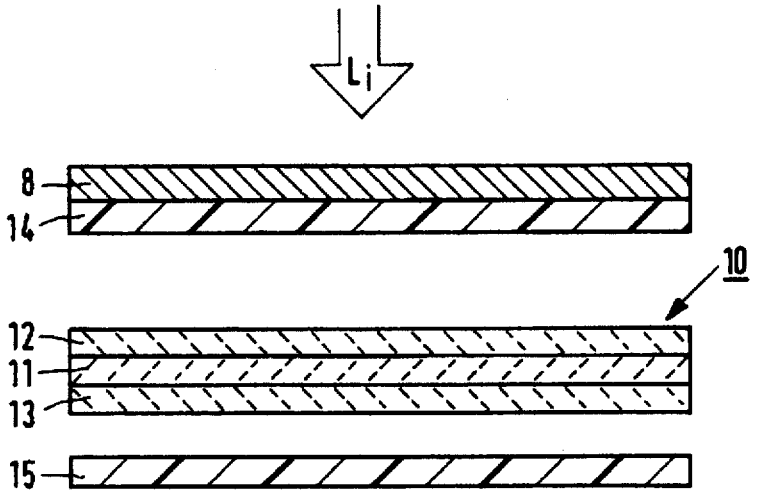
FIG. 2 is a cross-section of a liquid crystal display device.

FIG. 2 is a diagrammatic cross-section of a liquid crystal display device (LCD) having a plurality of liquid crystal cells 10 for displaying colors, comprising a liquid crystalline layer 11 between two electrode substrates 12, 13. The electrodes on the substrates 12, 13 are not shown in the Figure. For the sake of clarity, only one liquid crystal cell 10 is shown. The device has two polarizers 14, 15 in this case. The ambient light may enter the LCD both at the outer side of polarizer 14 and at the outer side of polarizer 15. In FIG. 2 the ambient light $L_i$, is incident at the outer side of polarizer 14; in that case a coating 8 as described above is provided on the outer side of polarizer 14.

Figure 3:
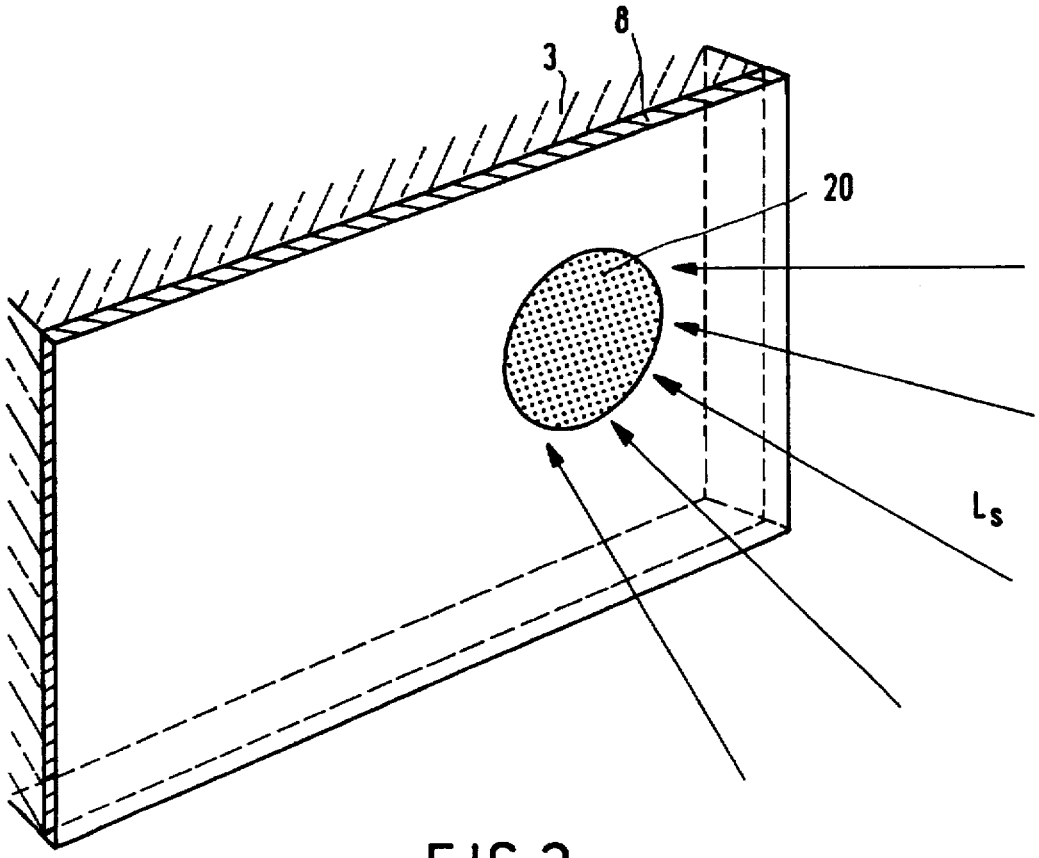
FIG. 3 is an elevational view of the display screen of a picture display device.

FIG. 3 is a diagrammatic elevational view of the front side of a picture display device, in which the outer side of display screen 3 is provided with a coating 8 according to the invention. From the ambience of the display device, a light spot 20 is incident on a pan of the display screen. Radiation $L_s$ producing the light spot 20 may originate, for example from sunlight which either directly or indirectly enters or does not enter through a window and is incident on a part of the display screen. The light spot 20 may also originate from another radiation source in the ambience of the picture display device, for example a lamp. FIG. 3 shows a circular light spot 20. However, light spot 20 may have any arbitrary shape and may irradiate a part of the display screen or the entire display screen of the picture display device. Light spot 20 may alternatively consist of a plurality of light spots. Particularly, the intensity of light spot 20 may differ from location to location on the display screen.

At the location of the light spot 20, the contrast of the reproduced picture on the display screen of the picture display device may be considerably reduced due to the intensity of light spot 20. It is a property of coating 8 that the transmission of coating 8 at the location of light spot 20 automatically decreases so that the contrast at the location of light spot 20 is enhanced.

In the known state of the art, the light sensor is necessarily arranged beside the display screen. In the case shown in FIG. 3, in which a light spot 20 is incident on a part of the display screen, the light sensor will thus not react. On the other hand, if light spot 20 is only incident on the light sensor and is not incident on the display screen, the transmission of the coating 8 will decrease, which is undesirable.

Figure 4:
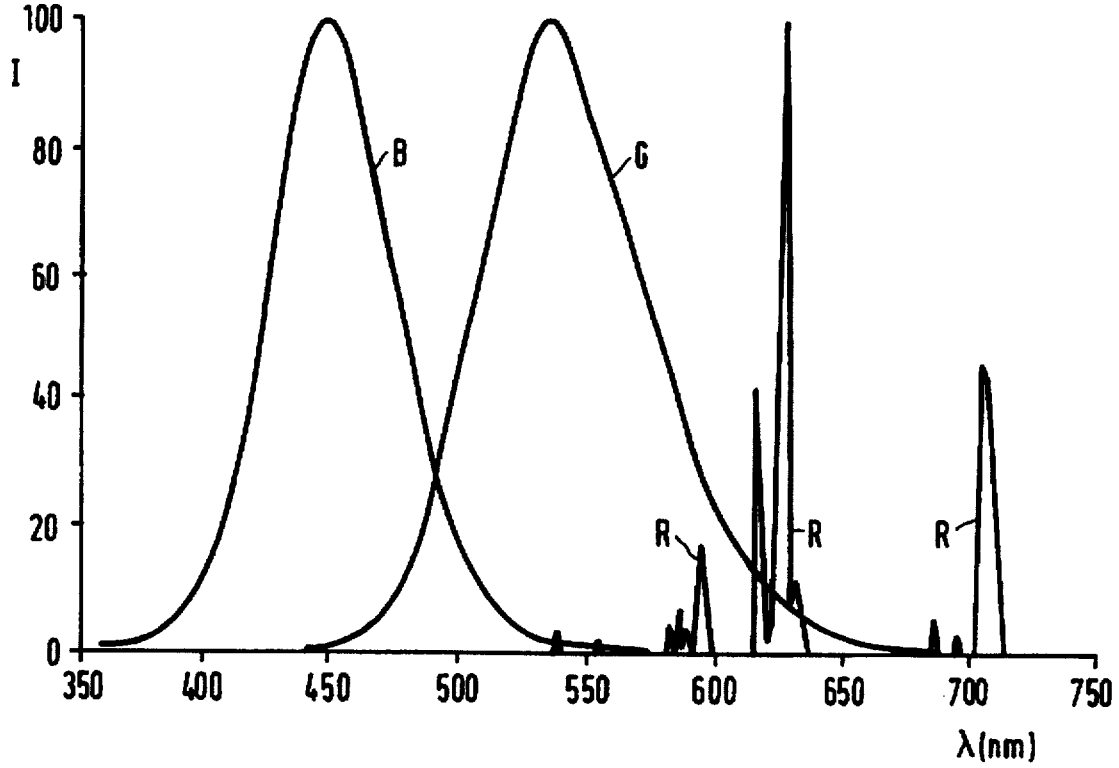
FIG. 4 shows the spectral emission of three types of electroluminescent phosphors.

FIG. 4 shows an example of the spectral emission I as a function of the wavelength λ (nm) of known CRT phosphors which emit light under the influence of electrons emitted by electron gun 6. Usually, three types of electroluminescent phosphors are used for a color display device, viz. a blue (B), a green (G) and a red (R) phosphor. In the range which is visible to the human eye, comprising the wavelength range between ~400 nm and ~780 nm, a number of ranges can be indicated where the known phosphors do not emit light or hardly emit light (<10%), viz. in the wavelength range from ~640 nm to ~680 nm and in the wavelength range from ~720 nm to ~780 nm (see FIG. 4). When the transmission of coating 8 is dependent on radiation in one of said sub-ranges (from ~640 to ~680 nm and from ~720 to ~780 nm) and is substantially independent of other wavelengths in the visible range, a coating is obtained having the characteristic feature that the transmission of the coating is dependent on radiation incident on the coating at a wavelength outside said spectral range. If the transmission of coating 8 is dependent on radiation of wavelengths which form part of the visible range, the coating will absorb light in the relevant wavelength range, which causes the non-activated coating to be non-neutral as regards color, which may be undesirable. An alternative preferred embodiment is characterized in that the transmission of coating 8 is substantially independent of radiation which is visible to the human eye, i.e. outside the wavelength range between ~400 nm and ~780 nm. A further special embodiment of a picture display device is characterized in that the transmission of the coating in said spectral range changes due to radiation which is incident on the coating at a wavelength of less than 400 nm, preferably less than 380 nm. This prevents the transmission of the coating from being influenced by both radiation from the visible range and by infrared radiation originating, for example from a thermal source proximate to the display screen.

A special embodiment of the picture display device is characterized in that the transmission of the coating in said spectral range changes due to radiation which is incident on the coating at a wavelength of more than 300 nm, preferably more than 350 nm. If the radiation which is incident on (a part of) the coating 8 originates from a radiation source, for example sunlight, whose radiation enters directly or indirectly through a window, the desired photochromic effect will still occur because window glass is transparent to radiation in the preferred wavelength range.

There is preferably a minimum of transmission of the coating, i.e. the absorption of the coating does not further increase if the intensity of the radiation incident on the coating exceeds a given limit value. A special embodiment of the picture display device is characterized in that the minimum transmission of the coating is 20%. Another desired property of the coating is that the period of time in which the transmission of the coating changes due to a change of intensity of the incident radiation is shorter than 5 minutes and preferably shorter than 1 minute. Moreover, small changes of intensity of the radiation incident on the coating do not need to cause a change of the transmission of the coating. A particular embodiment of the picture display device is characterized in that the coating is insensitive to light intensities of less than 100 lux. The average light intensity of approximately 100 lux in a room has been taken as a criterion in this case.

A large number of photochromic materials is known from the literature, which materials can be divided into several classes. A particular embodiment of the picture display device is characterized in that the coating comprises at least a material from the class of spiropyranes, spiro-oxazines or fulgides. An example of a photochromic material from the class of spiropyranes is 6-nitro-8-methoxy-1',3',3'-trimethylspiro[2H-1]benzopyrane-2,2'-indoline. An example of a photochromic material from the class of spiro-oxazines is 1,3,3-trimethylspiro[indoline-2,3'-[3H]napth[2,1-b][1,4]oxazine]. A large number of photochromic fulgides is published in U.S. Pat. No. 4,685,783. This class of fulgide materials has a high quantum efficiency in the near ultraviolet range, a low quantum efficiency for decoloration due to visible light and a rapid thermal decoloration at ambient temperatures, but not so rapid that the combination of decoloration due to white light and the thermal decoloration prevents the desired coloration from occurring due to the ultraviolet component of intense sunlight.

Examples of photochromic materials which absorb in the visible range are the alkyl-substituted spiro-heterocyclic compounds such as dephotochromic dye Photosol (R) 0272 marketed by PPG Industries.

Figure 5:
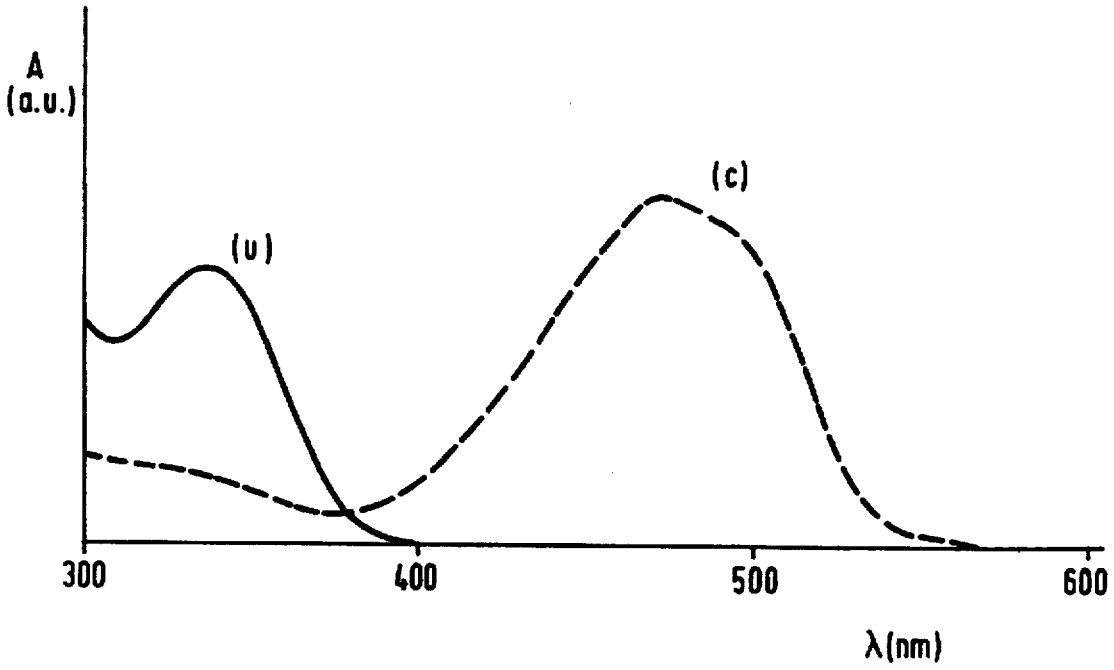
FIG. 5 shows the absorption spectra of a selectively transmissive coating in the colored and non-colored state.

FIG. 5 diagrammatically shows the absorption A as a function of the wavelength λ (nm) of a selectively transmissive coating comprising a furyl fulgide in an uncolored (u) and a colored (c) state. The absorption A is shown in arbitrary units. In the uncolored state, the absorption spectrum (u) has a maximum of between 300 and 400 nm. When radiation is absorbed by the material in this wavelength range, the absorption spectrum (c) is obtained so that the material is colored.

The invention is based on the recognition that it is desirable that the transmission of the coating changes uniformly in said spectral range. If the transmission of the coating does not change uniformly in said spectral range, for example the spectral range in which the electroluminescent phosphors emit, color effects will occur which are generally undesirable. A suitable combination of two or more photochromic materials, for example photochromic fulgides as disclosed in U.S. Pat. No. 4,685,783, may produce a coating having a color-neutral transmission throughout the desired spectral range and under all circumstances.

It will be evident that many variations within the scope of the invention can be conceived by those skilled in the art. If a cathode my tube (CRT) is used, the invention is, for example not limited due to the shape of this tube. The cathode ray tube may be, for example a flat tube. The display window of the cathode ray tube may be, for example curved. In addition to CRT and LC picture display devices, other embodiments may alternatively be used such as, for example plasma or field emission picture display devices and electrochromic or electroluminescent picture display devices.

The photochromic layer may also form part of a separate panel which is arranged in the light path at the outer side of the display screen. In a further embodiment, the photochromic layer is arranged at the inner side of the display screen, for example as a coating. If desired, the photochromic layer may be augmented with layers having an antireflective or antiglare effect or with layers which improve the scratch resistance or have an antistatic effect.

Generally, the invention provides a picture display device yielding a better enhancement of the contrast by using an automatic, selectively transmissive coating.

What is claimed is:

1. A picture display device, comprising a display screen, means for transmitting light in a spectral emission range to the display screen, and a selectively transmissive coating formed over said display screen, the local transmission of the coating in said emission range being dependent on the ambient radiation which is locally incident on the coating so that, at the location of the incident radiation, the transmission of the coating decreases as the intensity of the incident radiation increases.

2. The picture display device of claim 1, wherein the transmission of the coating in the emission range is dependent on the ambient radiation which is incident on the coating at a wavelength outside the substantial emission range.

3. The picture display device of claim 2, wherein the transmission of the coating in the emission range changes due to radiation which is incident on the coating at a shorter wavelength than the substantial emission range.

4. The picture display device of claim 3, wherein the transmission of the coating in the emission range changes due to radiation which is incident on the coating at a wavelength of less than approximately 400 nm.

5. The picture display device of claim 3, wherein the transmission of the coating in the emission range changes due to radiation which is incident on the coating at a wavelength of more than approximately 300 nm.

6. The picture display device of claim 2, wherein the transmission of the coating in the emission range changes due to radiation incident on the coating at a wavelength in the range between approximately 720 and 780 nm.

7. The picture display device of claim 2, wherein the spectral emission range comprises a plurality of sub-ranges, at least two of which are separated by an intermediate spectral range, and the transmission of the coating in the emission range is dependent on radiation incident on the coating at a wavelength in the intermediate spectral range.

8. The picture display device of claim 7, wherein the intermediate spectral range comprises wavelengths between approximately 640 and 680 nm.

9. The picture display device of claim 2, wherein the coating comprises a material selected from the group consisting of spiropyranes, spiro-oxazines and fulgides.

10. The picture display device of claim 2, wherein the transmission of the coating in the emission range is dependent on the radiation which is incident on the coating at a wavelength outside the substantial visible range.

11. The picture display device of claim 1, wherein the coating comprises an alkyl-substituted spiro-heterocyclic compound.

12. The picture display device of claim 1, wherein the transmission of the coating in the emission range is dependent on the radiation which is incident on the coating at a wavelength outside the substantial visible range.

13. The picture display device of claim 12, wherein the coating comprises a material selected from the group consisting of spiropyranes, spiro-oxazines and fulgides.

14. The picture display device of claim 1, wherein the transmission of the coating in the emission range changes due to radiation which is incident on the coating at a wavelength of more than approximately 300 nm and less than approximately 380 nm.

15. The picture display device of claim 1, wherein the spectral emission range comprises a plurality of sub-ranges, at least two of which are separated by an intermediate spectral range, and the transmission of the coating in the emission range is dependent on radiation incident on the coating at a wavelength in the intermediate spectral range.

16. The picture display device of claim 1, wherein the color point coordinates (x,y) of the coating in the C.I.E. chromaticity diagram are between 0.3 and 0.37.

17. The picture display device of claim 16, wherein the color point coordinates (x,y) of the coating in the C.I.E. chromaticity diagram are between 0.31 and 0.35.

18. The picture display device of claim 16, wherein the coating comprises a material selected from the group consisting of spiropyranes, spiro-oxazines and fulgides.

19. The picture display device of claim 1, wherein the coating comprises a material selected from the group consisting of spiropyranes, spiro-oxazines and fulgides.

20. The picture display device of claim 19, wherein the coating comprises a plurality of the materials selected from said group.

21. A picture display device, comprising a display screen, means for transmitting light in a spectral emission range to the display screen, and a selectively transmissive coating formed over the display screen, the local transmission of the coating in said emission range being dependent on the internal CRT radiation which is locally incident on the coating so that, at the location of the incident radiation, the transmission of the coating decreases as the intensity of the incident radiation increases.

* * * * *